US005300995A

United States Patent [19]

Ohgita et al.

[11] Patent Number: 5,300,995

[45] Date of Patent: Apr. 5, 1994

[54] FIXING UNIT FOR CONTROLLING THE MOVING SPEED OF THE FIXING SECTION

[75] Inventors: Toshiki Ohgita; Masato Tokishige, both of Nara; Takashi Kubo; Koichi Moriyama, both of Yamatokoriyama, all of Japan

[73] Assignee: Sharp Kabushiki Kaisha, Osaka, Japan

[21] Appl. No.: 893,757

[22] Filed: Jun. 5, 1992

[30] Foreign Application Priority Data

Jun. 6, 1991 [JP] Japan ..... 3-135135

[51] Int. Cl.[5] ..... G03G 15/20; G03G 21/00

[52] U.S. Cl. ..... 355/282; 355/285

[58] Field of Search ..... 355/282, 285, 289, 290, 355/295

[56] References Cited

U.S. PATENT DOCUMENTS 3,794,417 2/1974 Machmer ..... 355/290

4,017,067 4/1977 Soures et al. ..... 355/282 X 4,549,803 10/1985 Ohno et al. ..... 355/285 X 4,593,992 6/1986 Yoshinaga et al. ..... 355/290 X 4,595,279 6/1986 Kuru et al. ..... 355/282

5,053,829 10/1991 Field et al. ..... 355/290

FOREIGN PATENT DOCUMENTS 51-78342 7/1976 Japan .

*Primary Examiner*—Fred L. Braun

*Attorney, Agent, or Firm*—David G. Conlin; George W. Neuner

[57] ABSTRACT

A fixing unit for an image forming apparatus, for fixing a toner image transferred onto a recording sheet, which includes a fixing section having a heat roller and a pressure roller, includes a detector for detecting the time when the recording sheet reaches between the heat roller and the pressure roller; and a controller for controlling the moving speed of the fixing section to be gradually decreased when the recording sheet reaches the fixing section.

5 Claims, 3 Drawing Sheets

FIXING UNIT FOR CONTROLLING THE MOVING SPEED OF THE FIXING SECTION

BACKGROUND OF THE INVENTION

1. Field of the Invention

The present invention relates to a fixing unit used in an image forming apparatus such as an electrophotographic system.

2. Description of the Prior Art

In a copying machine of an electrophotographic system, an original document image is exposed to light and the reflected light is irradiated to a photosensitive drum to form an electrostatic latent image thereon, and toner is supplied to the electrostatic latent image, whereby a toner image is formed. The toner image on the photosensitive drum is transferred onto a recording sheet by a transfer unit and is fixed onto the recording sheet by the fixing unit.

The fixing of the fixing unit is performed by heating toner and pressing the thus melted toner against the recording sheet. The fixing unit has, for example, a heat roller and a pressure roller which presses against the heat roller. A heat lamp is inserted into the heat roller.

In the past, the rotation speeds of the heat roller and the pressure roller in the fixing unit have been almost constant between the time when the recording sheet is supplied and the time when it is discharged. Because of this, when a large sized recording sheet is used, or copying is performed at a high speed, the surface temperature of the heat roller is transmitted to the recording sheet at a high rate. Thus, the surface temperature of the heat roller is partly or temporarily decreased. Such a decrease in the surface temperature causes the difference in temperature between the leading edge and the trailing edge of the recording sheet to be supplied. In the conventional fixing unit, when a plurality of copies are made, it has been difficult to secure uniformity of the fixing at the initiation of copying and the finishing of copying. In addition, the difference in the fixing property is caused between the leading edge and the trailing edge of the same recording sheet.

In order to avoid such a decrease in the surface temperature of the heat roller, the heat roller can be made larger so as to increase the thermal capacity of the heat roller itself. However, this causes the copying machine to be enlarged, leading in an increase in cost.

SUMMARY OF THE INVENTION

The fixing unit for an image forming apparatus, for fixing a toner image transferred onto a recording sheet, which includes a fixing section having a heat roller and a pressure roller of this invention, comprises:

detecting means for detecting the time when the recording sheet reaches between the heat roller and the pressure roller; and control means for controlling the moving speed of the fixing section to be gradually decreased when the recording sheet reaches the fixing section.

According to the fixing unit of the present invention, when the recording sheet is passed through the fixing unit, the rotation speed of the heat roller is gradually decreased. Thus, the heating time of the recording sheet is increased and the decreased temperature due to thermal transmission from the heat roller to the recording sheet is compensated. The fixing properties at the time of the initiation of copying and the finishing of copying; and those of the leading edge and the trailing edge are made uniform.

Thus, the invention described herein makes possible the objectives of providing: (1) a fixing unit in which a decrease in temperature due to thermal transmission from the heat roller to the recording sheet is compensated and the fixing property is made uniform, whereby a stable image is formed; and (2) a fixing unit which is miniaturized by using a heat roller with small thermal capacity, leading to a decrease in cost.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENT

The present invention will be described by way of illustrating an example.

EXAMPLE

Figure 1:
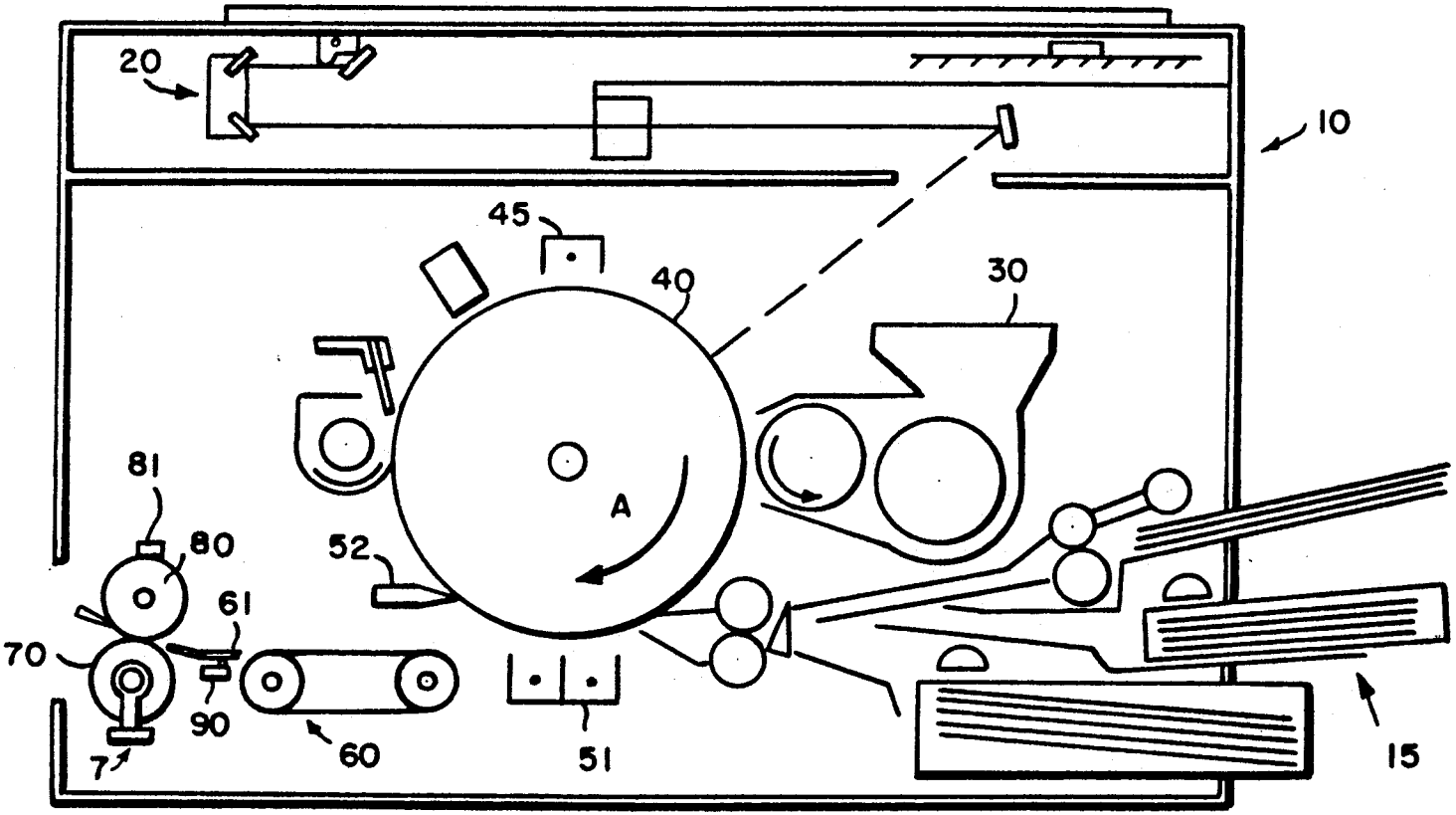
FIG. 1 is a front sectional view showing an example of a fixing unit of the present invention.

As shown in FIG. 1, in a copying machine, a photosensitive drum 40 is disposed at the vicinity of center of a copying machine body 10 so as to rotate in the direction of arrow A. On the surface of the photosensitive drum 40, an original document image is exposed to light by an optical system 20. Prior to the exposure to light, the surface of the photosensitive drum 40 is uniformly charged by a charger 45. Thus, on the photosensitive drum 40, an electrostatic latent image corresponding to the original document image is formed. Toner is supplied to the electrostatic latent image on the photosensitive drum 40 by a developing unit 30 disposed on the side of the photosensitive drum 40, whereby a toner image is formed. The toner image is then moved to the position of a transfer charger 51 and transferred onto a recording sheet P which is transported thereto (see FIG. 2).

The recording sheet P is transported to the position of the transfer charger 51, synchronized with the rotation of the photosensitive drum 40. The size of the recording sheet P is detected by a paper size detecting sensor 96 when the recording sheet P is sent out of a sheet supply cassette 15. The detection result of the paper size detecting sensor 96 is input into a CPU 92 (see FIG. 3). The recording sheet P on which the toner image is transferred is separated from the photosensitive drum 40 by a separating unit 52 and transported to a fixing unit 7 by a transporting unit 60. A transporting guide 61 is provided above the transporting unit 60.

Figure 2:
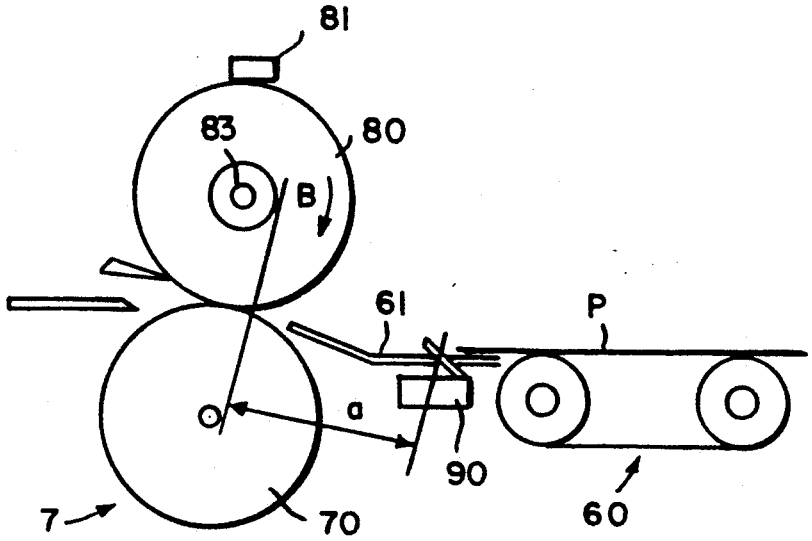
FIG. 2 is a sectional view showing a portion of the fixing unit of FIG. 1.

Next, the fixing unit will be described in detail with reference to FIG. 2. The fixing unit 7 has a heat roller 80 and a pressure roller 70 disposed under the heat roller 80 so as to be pressed against it. The heat roller 80 is rotated in the direction of arrow B by a motor 95 shown in FIG. 3.

The heat roller 80 is hollow. A heat lamp 83 is inserted into a hole of the heat roller 80, whereby the heat roller 80 is heated from inside. On the surface of the heat roller 80, a thermistor 81 for detecting the temperature is provided. The detection signal from the thermistor 81 is input into the CPU 92 via an I/O section 91 (input/output interface) as in FIG. 3.

Figure 3:
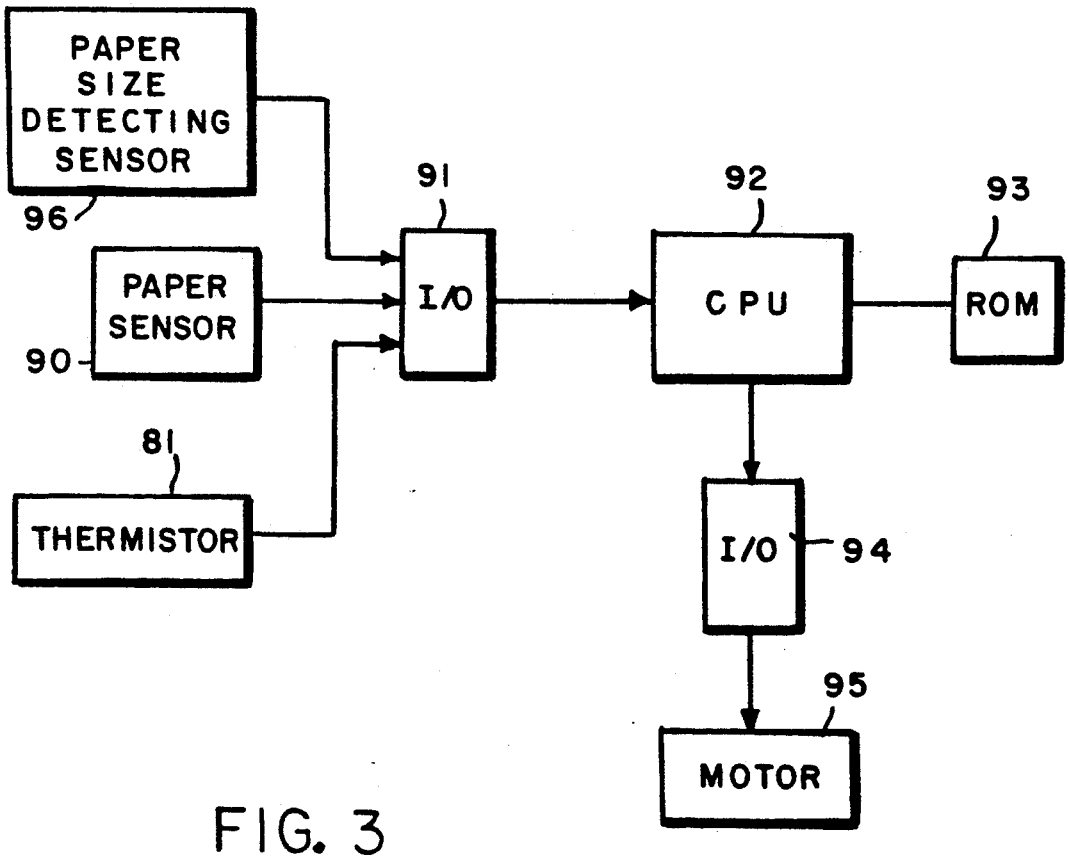
FIG. 3 is a block diagram showing a control system of the fixing unit of the present invention.

Next, a control system of the fixing unit of the present invention will be described with reference to FIG. 3. In this figure, the detection signal from a paper sensor 90 is input into the CPU 92 via the I/O section 91. The CPU 92 performs the following control in accordance with a program for controlling stored in a ROM 93. More specifically, when the detection signal of the paper sensor 90 is input into the CPU 92, the CPU 92 generates a predetermined driving signal through an I/0 section 94 to the motor 95, thereby controlling the speed of the motor 95.

Figure 4:
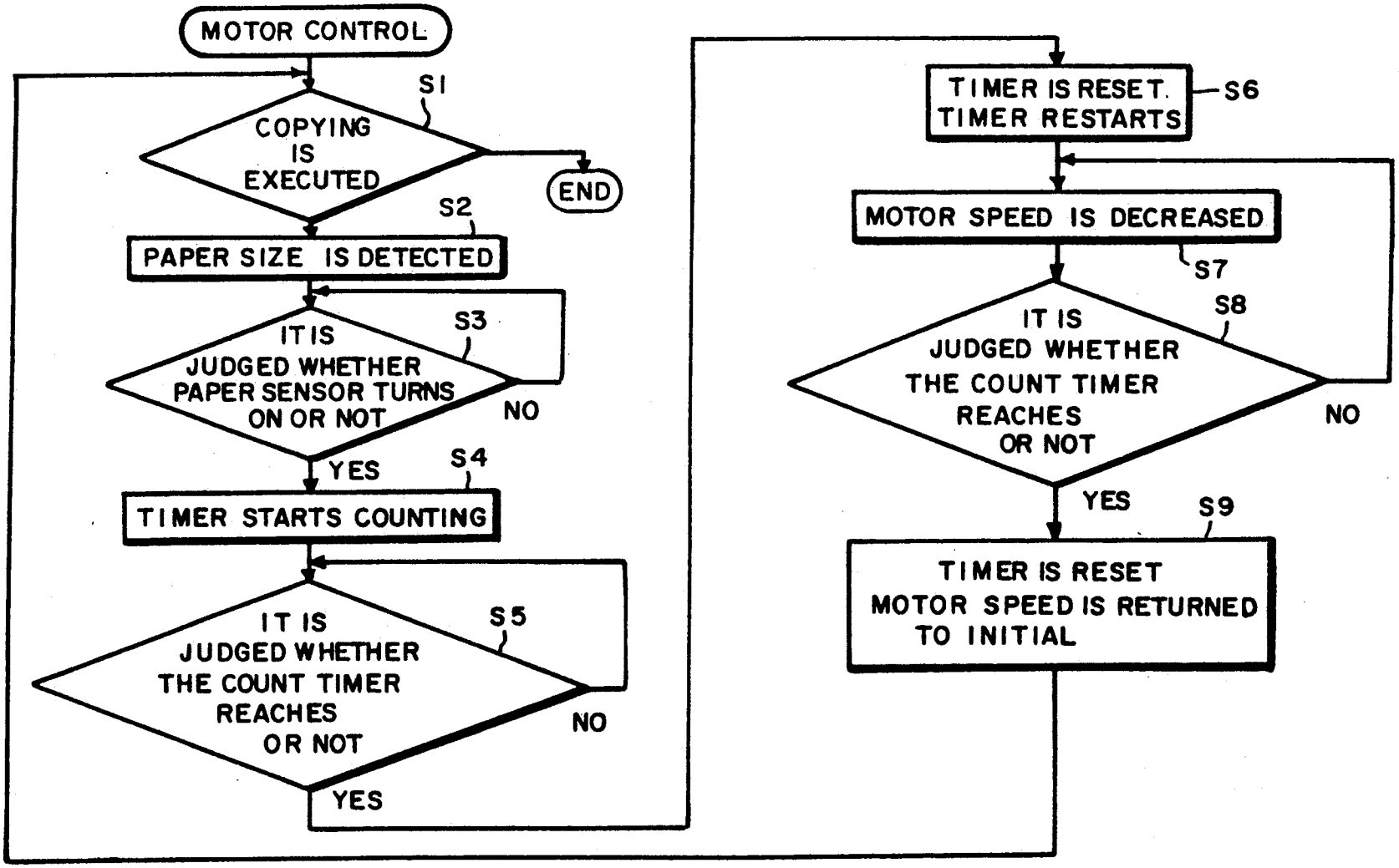
FIG. 4 is a diagram showing a control procedure of a CPU 92 in controlling a motor rotation of the fixing unit of the present invention.

Next, the control procedure of the CPU 92 in controlling the motor rotation will be described with reference to FIG. 4. In Step S1, the CPU 92 first judges whether a copying is executed or not. Whether the copying is executed or not is judged in accordance with the ON/OFF state of a copy switch. When the execution of copying is confirmed, the CPU 92 detects the size of the recording sheet P due to the detection signal from the paper size detecting sensor 96 in Step S2. Then, in Step S3, it is judged whether the paper sensor 90 turns on or not. When it is confirmed that the paper sensor 90 turns on, an internal timer starts counting in Step S4.

In Step S5, it is judged whether the count time of the internal timer reaches ta or not. Here the ta corresponds to the time necessary for the recording sheet P to be transported in a distance a (FIG. 2) from the position of the paper sensor 90 to the position where the heat roller 80 and the pressure roller 70 are pressed with each other.

When the internal timer confirms that the count time reaches ta, the internal timer is reset and counting is started again in Step S6. In Step S7, the rotation speed of the motor 95 is controlled so as to be gradually decreased. In Step S8, it is judged whether the count time of the timer which starts counting after being reset reaches tb or not. Here, the tb is between the time when the leading edge of the recording sheet P reaches the position where the heat roller 80 and the pressure roller 70 are pressed with each other and the time when the trailing edge reaches the position. The tb is set in accordance with each length of the recording sheet P.

When it is confirmed that the count time reaches tb, the timer is reset, and the rotation speed of the motor 95 is returned to the initial state in Step S9. After that, the CPU 92 returns to Step S1, and completes this procedure at the time when the copying is finished.

In the above-finished example, the fixing unit having the heat roller and the pressure roller is described; however, a belt fixing unit, in which a fixing belt is extended around the heat roller and the fixing belt performs a fixing step, can be applied in the same way.

The fixing unit of an image forming apparatus according to the present invention has a structure in which heat quantity lost by thermal transmission to the recording sheet is compensated by controlling the rotation speed of the heat roller at a lower speed. Thus, the fixing temperatures at the time =of the initiation of copying and the finishing of copying; and those of the leading edge and the trailing edge of the recording sheet are made uniform. Accordingly, the fixing property is made uniform and a stable image can be realized. In addition, it is not necessary to enlarge the heat roller for the purposes of increasing thermal capacity, so that the fixing unit can be miniaturized, leading to a decrease in cost.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A fixing unit for an image forming apparatus, for fixing a toner image transferred onto a recording sheet, which includes a fixing section having a heat roller and a pressure roller, comprising:

detecting means for detecting the time when the recording sheet reaches between the heat roller and the pressure roller; and control means for controlling the moving speed of the fixing section to be gradually decreased when the recording sheet reaches the fixing section.

2. A fixing unit for an image forming apparatus according to claim 1, wherein the control means gradually decreases the moving speed of the fixing section during the time required for the recording sheet to pass between the heat roller and the pressure roller, which is set in accordance with the size of the recording sheet.

3. A fixing unit for an image forming apparatus, for fixing a toner image transferred onto a recording sheet, which includes a fixing section having a heat roller and a pressure roller, the fixing unit comprising:

detecting means for detecting that a leading edge of the recording sheet reaches a fixing area between the heat roller and the pressure roller, and for generating a detection signal; and control means for receiving the detection signal, and for controlling the moving speed of the fixing section to be gradually decreased in response to the detection signal, until a trailing edge of the recording sheet passes through the fixing area.

4. A fixing unit for an image forming apparatus, for fixing a toner image transferred onto a recording sheet, which includes a fixing section having a heat roller and a pressure roller, the fixing unit comprising:

detecting means for detecting that a leading edge of the recording sheet reaches a fixing area between the heat roller and the pressure roller, and for generating a detection signal; and control means for receiving the detection signal, and for controlling the moving speed of the fixing section to be gradually decreased when a predetermined period of time passes from the reception of the detection signal, until a trailing edge of the recording sheet passes through the fixing area.

5. A fixing unit for an image forming apparatus, for fixing a toner image transferred onto a recording sheet, which includes a fixing section having a heat roller and a pressure roller, the fixing unit comprising:

detecting means for detecting that a leading edge of the recording sheet reaches a fixing area between the heat roller and the pressure roller, and for generating a detection signal; and timer means for receiving the detection signal, the timer means starting to count in response to the detection signal, and for generating a timing signal when a predetermined period of time passes from the reception of the detection signal; and control means for receiving the timing signal and for controlling the moving speed of the fixing section to be gradually decreased from the reception of the timing signal, until a trailing edge of the recording sheet passes through the fixing area.

* * * * *